US008529246B2

(12) United States Patent
Gruenler et al.

(10) Patent No.: US 8,529,246 B2
(45) Date of Patent: Sep. 10, 2013

(54) DEVICE AND METHOD FOR MAINTAINING AND OPERATING A FLAME

(75) Inventors: Bernd Gruenler, Zeulenroda (DE); Jens Ploetner, Hermsdorf (DE); Hans-Juergen Tiller, Jena (DE); Christian Tiller, Jena (DE)

(73) Assignee: Innovent E.V. Technologieentwicklung, Jena (DE)

( * ) Notice: Subject to any disclaimer, the term of this patent is extended or adjusted under 35 U.S.C. 154(b) by 535 days.

(21) Appl. No.: 12/863,092

(22) PCT Filed: Jan. 16, 2009

(86) PCT No.: PCT/DE2009/000052

§ 371 (c)(1),
(2), (4) Date: Jul. 15, 2010

(87) PCT Pub. No.: WO2009/089830

PCT Pub. Date: Jul. 23, 2009

(65) Prior Publication Data

US 2011/0053101 A1 Mar. 3, 2011

(30) Foreign Application Priority Data

Jan. 18, 2008 (DE) ..... 10 2008 005 474

(51) Int. Cl.
*F23C 15/00* (2006.01)

(52) U.S. Cl.
USPC ..... 431/1; 431/2; 431/4; 431/8; 431/258; 431/264

(58) Field of Classification Search
USPC ..... 431/1, 2, 4, 8, 258, 264
See application file for complete search history.

(56) References Cited

U.S. PATENT DOCUMENTS

| | | | | |
|---|---|---|---|---|
| 2,600,928 | A * | 6/1952 | Semm | 331/66 |
| 3,767,922 | A * | 10/1973 | Towlson | 250/340 |
| 4,523,905 | A * | 6/1985 | Lewis | 431/351 |
| 5,725,151 | A * | 3/1998 | Hetrick et al. | 239/3 |
| 5,876,684 | A * | 3/1999 | Withers et al. | 423/445 B |
| 6,388,227 | B1 * | 5/2002 | Dykhno et al. | 219/121.6 |
| 6,398,125 | B1 * | 6/2002 | Liu et al. | 239/13 |
| 6,441,554 | B1 * | 8/2002 | Nam et al. | 315/111.21 |
| 6,657,152 | B2 * | 12/2003 | Shimazu | 219/121.47 |
| 6,800,336 | B1 * | 10/2004 | Fornsel et al. | 427/562 |
| 6,883,507 | B2 * | 4/2005 | Freen | 123/606 |
| 7,137,808 | B2 * | 11/2006 | Branston et al. | 431/8 |
| 7,243,496 | B2 * | 7/2007 | Pavlik et al. | 60/776 |
| 7,557,324 | B2 * | 7/2009 | Nylen et al. | 219/121.47 |
| 7,632,379 | B2 * | 12/2009 | Goto et al. | 156/345.44 |
| 7,651,585 | B2 * | 1/2010 | Yoon et al. | 156/345.43 |
| 7,662,253 | B2 * | 2/2010 | Yoon et al. | 156/345.43 |
| 8,298,433 | B2 * | 10/2012 | Yoon et al. | 216/67 |

(Continued)

*Primary Examiner* — Kenneth Rinehart
*Assistant Examiner* — Jorge Pereiro
(74) *Attorney, Agent, or Firm* — Jordan and Hamburg LLP

(57) ABSTRACT

Disclosed is a device and a method for maintaining and operating a flame. The device has a burner, a burner attachment having an outlet geometry, wherein on a side of the burner attachment facing away from the burner, an anode is provided on one side of the outlet geometry of the burner attachment. A dielectric is provided on the other side of the outlet geometry, wherein a cathode is located in the dielectric. The device and method: do not require continuous flame monitoring; positively influence the deposition behavior of layer-forming components of the fuel gas flame; and reduce the thermal impact of the burner and the operating costs thereof.

2 Claims, 2 Drawing Sheets

(56) References Cited

U.S. PATENT DOCUMENTS

2004/0185397 A1* 9/2004 Branston et al. ..... 431/2
2005/0016456 A1* 1/2005 Taguchi et al. ..... 118/723 E
2005/0208442 A1* 9/2005 Heiligers et al. ..... 431/1
2006/0040067 A1* 2/2006 Culp et al. ..... 427/569
2006/0042545 A1* 3/2006 Shibata et al. ..... 118/722
2007/0020567 A1* 1/2007 Branston et al. ..... 431/8
2007/0026354 A1* 2/2007 Branston et al. ..... 431/350

* cited by examiner

DEVICE AND METHOD FOR MAINTAINING AND OPERATING A FLAME

BACKGROUND OF THE INVENTION

The invention relates to a device and method for maintaining and operating a flame.

Gas burners, in which a flame is produced by a continuously burning flow of gas are known in the art. The flame can be used to deposit layers on diverse substrates and to also to modify surfaces of items.

The known burners are disadvantageous in that the flame must be continuously produced in an operating state after a single ignition. Thus, the flame requires a high fuel gas mixture consumption and consequently incurs high operating costs. The deposition behavior of layer-forming components is negatively influenced by the thermal impact of such a known burner.

Furthermore, the flame must be continuously monitored due to the risk of explosion and production facilities that operate a large number of burners or extensive burner flames must take extreme safety precautions to avoid explosions.

SUMMARY OF THE INVENTION

The object of the invention is to overcome the disadvantages of prior art by providing a device and method for maintaining and operating a flame that does not require continuous flame monitoring, while positively influencing the deposition behavior of layer-forming components of the burner gas flame and reducing the thermal impact of the burner and the operating costs thereof compared to prior art.

The invention provides controlled ignition of a fuel gas mixture by combining an ignition source with a flame. An ignition source initiates the oxidation or combustion of the fuel gas mixture. In particular, the ignition source can be a corona or battery discharge.

In the disclosed method of the present invention, the flame-producing gas mixture is lead through or channeled past the ignition source so that a simultaneous ignition of the gas mixture is possible over the whole burner extension.

Consequently, the inventive method makes it possible to ignite combustible gas mixtures that do not burn without the support of the ignition source and thus the flame can be maintained.

The invention allows operation of flames in a non-pulsed or pulsed, continuous or discontinuous mode and the pulse frequency (i.e., alternating between on and off positions) and/or the ignition energy of the ignition source can be varied over extensive ranges so that a high variability of the flame geometry and the flame parameters is attained. In this way the deposition behavior of the layer-forming components or most diverse surface modifications (e.g. hydrophobizing of the surface energy) can be positively influenced.

BRIEF DESCRIPTION OF THE DRAWINGS

The invention is explained with reference to the following figures without intent of limiting the scope of claimed subject matter to the disclosed embodiment(s). They show:

DETAILED DESCRIPTION OF THE INVENTION

Figure 1:
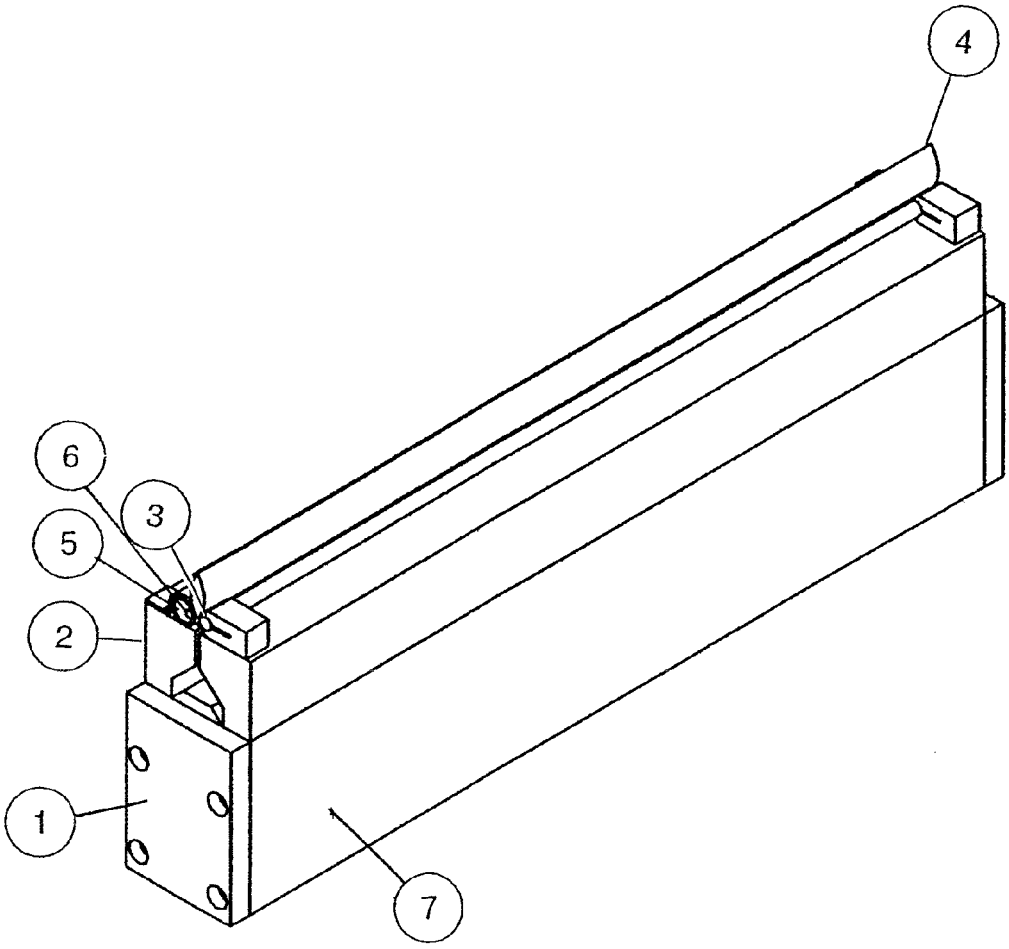
FIG. 1 depicts an embodiment of the inventive device in the operating state in a basic representation.
Figure 2:
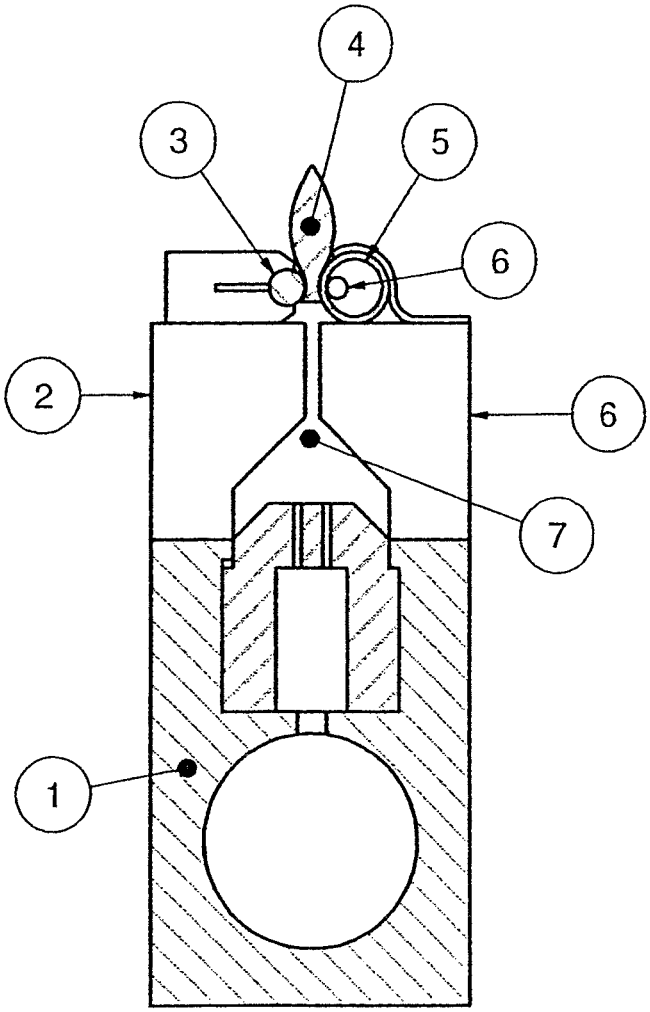
FIG. 2 depicts the embodiment according to FIG. 1 in a cross-sectional view.

The inventive device shown in FIG. 1 comprises a burner (1), a burner attachment (2), an anode (3), a flame (4) in its operating state, a dielectric (5), a cathode (6), and an outlet geometry (7).

The burner attachment (2) is mounted on a known burner (1) and the electrically impeded barrier is mounted on said attachment. The electrically impeded barrier has an anode (3) and a cathode (6), the latter of which is insulated by a dielectric (5). If a voltage is applied between the anode (3) and the cathode (6), a dielectrically impeded discharge is initiated between the anode (3) and the cathode (6) through the dielectric (5). The discharge ignites the fuel gas that flows through the burner (1) and the burner attachment (2) with an appropriate outlet geometry (7) through the barrier.

A not independently flammable gas mixture can be fed to the inventive device and be ignited by the dielectrically impeded barrier, and thus the flame geometry can be controlled via the barrier voltage and/or the pulse width of the barrier discharge.

A not independently flammable gas can be generated, for example, by reducing the fuel gas content relative to the amount of oxygen (e.g. from 5% to 2.75% for propane). Thus, the required fuel gas concentration is reduced, and consequently, the fuel gas consumption is decreased by more than 40% when compared to conventional burners.

Reactive and/or layer-forming substances or components such as metal-organic compounds or suitable halides, or hybrids in powder form, as gases or liquids in a mixture (e.g. as a solution or a single component) can be added to the fuel gas mixture. The addition to the fuel gas mixture can either be realized before ignition, and thus before the ignition source, e.g. the corona or barrier discharge, or alternatively, only when the fuel gas mixture has passed the ignition source (corona or barrier discharge).

The corona/barrier and the flame can be combined in different geometrical shapes. Linear, bended or circular corona or barrier geometries can be used. Depending on the gas flow, the outlet cross section geometry can have different shapes.

Organic gases and also hydrogen can be used as the fuel gas for the flame. In an inert gas flow, oxygen is added to this fuel gas. The inert gas can be nitrogen or other inert gases.

Example

A commercially available burner with a length of 300 mm is employed. A ceramic attachment having a length of 270 mm and a height of 30 mm, having a gap geometry with a width of 2.5 mm is screwed onto the burner. A cathode insulated by a 1 mm dielectric of aluminum oxide is mounted on the upper gap edge over the total burner width. The Kanthal anode is adjusted parallel to the cathode at a distance of 2.5 mm. A barrier voltage of 100 KV is applied between the anode and the cathode. The voltage source has a HV generator with an input that can be clock-pulsed and is connected with a generator. At the burner inlet, a 0.6 percent precursor TMS (tetramethyl silane) is added to the propane via a venturi tube. In this process, the following volume flow rates are used:

air volume flow rate 200 l/min propane volume flow rate (with 0.6 percent TMS) 5.6 l/min A discontinuous operation of the process has been achieved by connecting and disconnecting the barrier voltage. The propane volume flow can be additionally connected or disconnected in a delayed mode.

An optimum homogeneous deposition (30 nm) on glass specimens, which are guided under the flame at a distance of 20 mm and a speed of 170 mm/s, is achieved by a 50 Hz-pulsed barrier voltage in the ratio alternating between on and off positions of on and off of 1:2.

It is within the invention that in the inventive device and method:

- a mixture of fuel gas, an oxygen-containing inert gas and a layer-forming gaseous, liquid or solid additive is ignited by means of a ignition source (e.g. barrier discharge) and the produced flame is maintained;
- the ignition source (e.g. barrier discharge) is operated in a pulsed mode in the range of between 0 Hz to 100 Hz, with a pulse ratio alternating between on and off positions of from 2:1 to 1:3;
- a continuous or discontinuous operation of the inventive burner is possible;
- the gas mixture or parts thereof flow through the ignition source (e.g. barrier discharge);
- the gas mixture or parts thereof are channeled past the ignition source (e.g. barrier discharge);
- an alkane, preferably propane, butane or methane, is used as a single substance or in a mixture as the fuel gas;
- a hydrocarbon or a mixture of hydrocarbons is used as the fuel gas;
- the mixture, in its composition, is preferably below the explosion limit and does not produce a self-maintaining flame;
- air or an oxygen-containing inert gas is added to the fuel gas and the mixture is preferably below the explosion or ignition composition;
- the mixture of air and propane is used in the ratio of >20 to 1, advantageously from 23 to 1 to 40 to 1;
- the layer-forming component, separated from the carrier gas and fuel gas, is added to the carrier gas and fuel gas after having passed the ignition source (e.g. barrier discharge);
- the fuel gas and the carrier gas pass the ignition source (e.g. barrier) and the layer-forming components are added to the carrier gas and fuel gas before passing the barrier discharge;
- the layer-forming component is a silicon-organic or metallorganic compound;
- the layer-forming component is a hydride or halide;
- the layer-forming compound is added to an organic liquid, preferably alcohol;
- the layer-forming component is a metallic salt that is dissolved in an organic medium, preferably an alcohol;
- the ignition source (e.g. barrier discharge) has the shape of a linear gap;
- the ignition source (e.g. barrier discharge) has the shape of a circular gap;
- the ignition source (e.g. barrier discharge) is segmented;
- the gas guidance through the ignition source (e.g. barrier discharge) has a vertical profile, and the barrier is advantageously arranged at the most narrow part of the vertical profile, and further, the outlet geometries can vary;

and

- single inventive devices can be operated in cascades next to each other or one behind the other above a substrate so that layer-forming substances or components can be deposited on large areas of the substrate by flame-aided deposition.

The inventive device and inventive method allow for maintenance and operation of a flame by barrier discharge, and the flame can be switched on and off continuously or discontinuously in a pulsed mode.

Owing to the precise clock-pulsing and design of the barrier, diverse surface morphologies can be generated through flame deposition.

The invention claimed is:

1. A method for maintaining and operating a flame employing a device comprising a burner, a burner attachment having an outlet geometry, wherein on the side of the burner attachment facing away from the burner an anode is provided on one side of the outlet geometry of the burner attachment and a dielectric is provided on the other side of the outlet geometry of the burner attachment, and a cathode is located inside the dielectric, the method comprising:

flowing a fuel gas mixture below a self-ignition limit for the mixture through the outlet geometry;

igniting a flame; and controlling a temperature and a geometry of the flame through preselected variation of at least one of a frequency of turning the flame on and off, a pulse ratio, and a barrier voltage of a discharge selected from corona discharge and barrier discharge, whereby deposition behavior and change of surface morphology or surface characteristics are effected by the control.

2. A method for maintaining and operating a flame employing a device comprising a burner, a burner attachment having an outlet geometry, wherein on the side of the burner attachment facing away from the burner an anode is provided on one side of the outlet geometry of the burner attachment and a dielectric is provided on the other side of the outlet geometry of the burner attachment, and a cathode is located inside the dielectric, the method comprising:

flowing a fuel gas mixture below a self-ignition limit for the mixture through the outlet geometry;

igniting a flame;

controlling a temperature and a geometry of the flame through preselected variation of at least one of a frequency of turning the flame on and off, a pulse ratio, and a barrier voltage of a discharge selected from corona discharge and barrier discharge, whereby deposition behavior and change of surface morphology or surface characteristics are effected by the control; and adding a layer-depositing additive in a powder, gaseous or liquid form to the fuel gas mixture after discharge selected from corona discharge and barrier discharge.

* * * * *